US005299671A

United States Patent [19]

Garland

[11] Patent Number: 5,299,671

[45] Date of Patent: Apr. 5, 1994

[54] COIN EXCHANGER

[76] Inventor: Clifford Garland, 149 Van Brunt St., Brooklyn, N.Y. 11231

[21] Appl. No.: 683,612

[22] Filed: Apr. 11, 1991

[51] Int. Cl.[5] ..... G07D 5/08; A45C 1/12

[52] U.S. Cl. ..... 194/310; 446/9; 453/41

[58] Field of Search ..... 194/310, 312; 446/9, 446/10, 12; 453/21, 41

[56] References Cited

U.S. PATENT DOCUMENTS 1,007,167 10/1911 Wickline ..... 453/21
1,325,766 12/1919 Thompson ..... 194/310
1,961,537 6/1934 Velazquez ..... 194/312
3,243,914 4/1966 Poynter ..... 194/310 X
3,512,298 5/1970 Poynter ..... 446/9

*Primary Examiner*—F. J. Bartuska
*Attorney, Agent, or Firm*—Richard L. Miller

[57] ABSTRACT

An electrically operated coin exchanger has a shallow slot into which a coin is inserted. A motor is actuated by the coin, the coin exchanger vibrates, a lid on the normally closed top of the device opens, and a simulated hand appears which grasps the coin and pulls it inside the box as the lid closes. A coin or token unlike that inserted into the slot then appears from an opening near the bottom of the coin exchanger.

9 Claims, 3 Drawing Sheets

COIN EXCHANGER

BACKGROUND OF THE INVENTION

1. Field of the Invention

This invention relates to a coin exchanger which is useful as a coin saver, a dispenser of a foreign coin or token in exchange for a United States or other coin, and an entertaining and fanciful device. In operation, a coin is placed in a slot on top of a closed plastic box, and a hand reaches up from the top of the box to retrieve the coin and retract it into the box. A foreign coin or token then is dispensed from an opening in the box.

2. Description of the Prior Art

There is described in U.S. Pat. No. 3,243,914 to Poynter a closed plastic box having a shallow coin slot on its top where insertion of a conducting coin into the slot actuates a battery operated electric motor. The coin box vibrates, and a portion of the lid opens and a simulated hand appears from the inside of the box to grasp the coin and quickly pull the coin into the box where it is stored and saved. Reference may be made to this prior art for a description of its construction and operation.

The present invention is an improvement over the referenced prior art, and adds to it a unique feature in which a coin or token is dispensed from the box through an opening in a side of the box. By virtue of this improvement the prior art device can be used as a coin exchanger in addition to its previous use as a coin bank and an entertainment.

It is an object of the present invention to provide a novel coin operated device which can be used as a coin saver, an entertainment and as a device for exchanging a specific coin for another coin or token.

Another object of this invention is a coin exchanger which is useful for exchanging a coin for a foreign coin and simultaneously provide entertainment.

A further object of this invention is an electrically operated coin exchanger in which insertion of a coin actuates a batter operated mechanism which causes the device to vibrate, opens a lid on the top from which a hand appears to grasp the coin and retract it into the device, and then dispenses a coin or token different from the original coin.

SUMMARY OF THE INVENTION

The objects of the invention are produced by incorporating into a prior art device a unique mechanism whereby a plurality of coins are stored, the bottommost of which is in a channel which also contains a reciprocating member. Upon insertion of a coin into the receptacle, a motor actuates a series of gears, one of which has an arm connected to one end of the reciprocating member. Rotation of the gear causes the reciprocating member to move away from the stack of coins permitting the lowermost coin to fall into the channel, and further rotation of the gear causes the reciprocating member to push the coin through the channel and through an opening in the side of the apparatus. The operation of the gear is timed so that the coin appears from the opening in the wall after the hand retrieves the original coin and returns it into the coin exchanger.

BRIEF DESCRIPTION OF THE DRAWING FIGURES

The figures in the drawings are briefly described as follows:

FIG. 1 is a diagrammatic perspective view with the box illustrated in phantom showing the internal parts; and FIG. 2 is a diagrammatic perspective view of the gear train; and FIG. 3 illustrates the hand in its retracted position and in the process of emerging; and FIG. 4 illustrates the hand in its topmost position and returned to its starting position; and FIG. 5 is a diagrammatic view showing the coin ejection mechanism pushing a coin from the opening; and FIG. 6 is a view similar to FIG. 5 but showing the coin prior to its ejection; and FIG. 7 is a schematic of the electrical circuitry of this invention; and FIG. 8 shows in perspective the hand grasping the coin; and FIGS. 9 and 10 illustrate the mechanism for disengaging the retrieved coin from the hand.

DESCRIPTION OF THE PREFERRED EMBODIMENT

Figure 1:
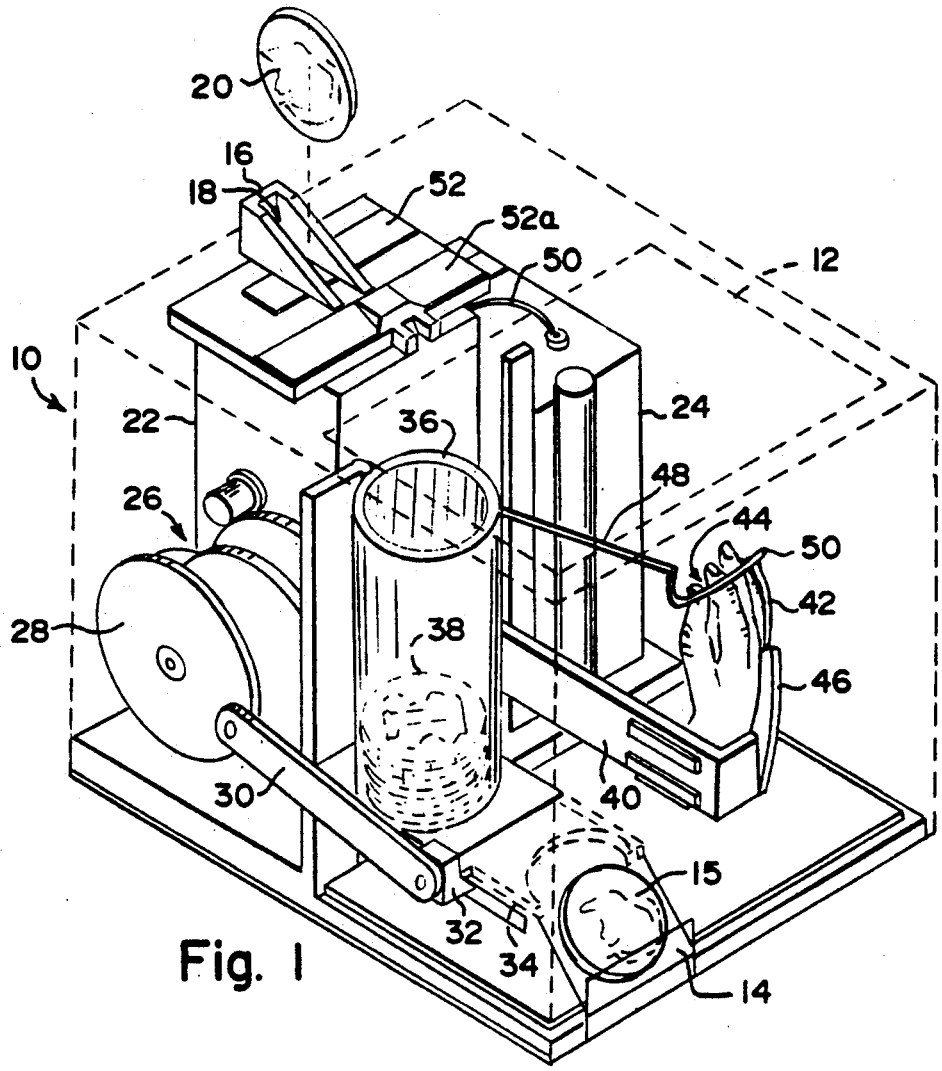

Referring to FIG. 1 there is shown in phantom a rectangular case or box 10, preferably of plastic, which has a lid 12 on the top thereof which can be raised and lowered. Near the bottom of one sidewall is an opening 14 from which a coin 15 is about to emerge. A raised portion 16 defines a slot 18 adapted to receive a coin 20. Coin 20 must be electrically conductive.

Figure 2:
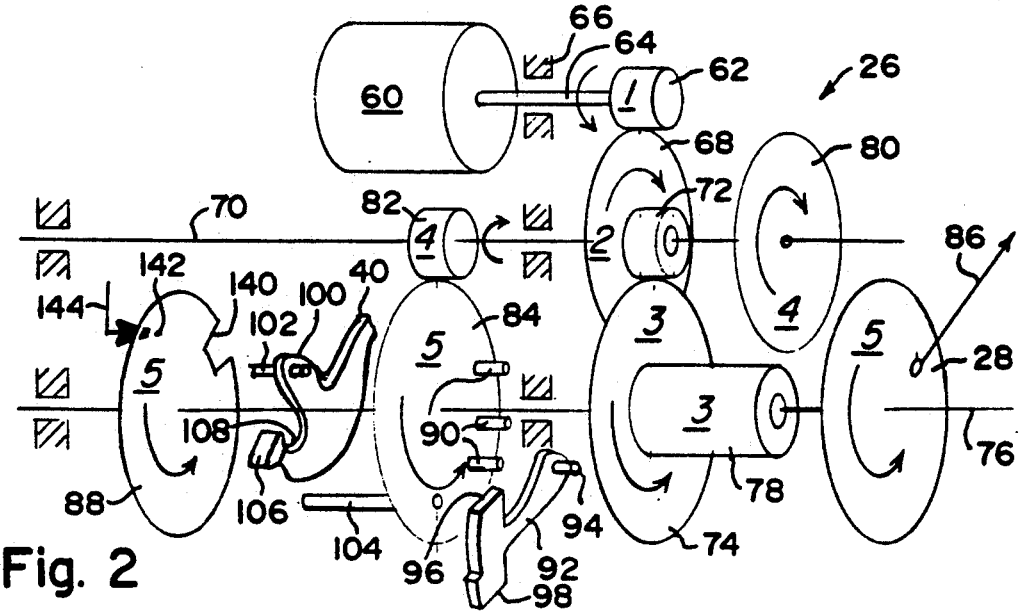

Inside the box 10 are an electric motor 60 shown in FIG. 2 located in a case 22, a case 24 containing two 1.5 volt storage batteries, not shown, with appropriate contacts, and a plurality of gears 26 driven by the motor 60. Outermost gear 28 is connected via arm 30 mounted for rotation at both ends to a slidably reciprocating plate 32 which moves back and forth in a slot or channel 34 shown in dashed lines, channel 34 terminating in slot 14. A cylindrical element 36 preferably of plastic serves to store a plurality of coins, tokens or the like shown at 38. A rotatable operating arm 40 has a flexible plastic or rubber hand 42 attached to its end. A space 44 between the thumb and index finger of hand 42 is adapted to grasp the coin 20.

Mounted to arm 40 outside the hand 42 is a projection 46 of a hard plastic which serves to open lid 12 when arm 40 is rotated. A wire rod 48 has a curved end portion 50 which surrounds hand 42. The rod 48 is hinged for vertical movement on the wall of case 22 as shown best in FIG. 10. Rod 48 moves in response to movement of hand 42 upwardly and serves to force the coin from hand 42 when it is retracted into the box 10.

The batteries in case 24 are connected to the motor 60 case 22 via wire 50. Mounted on the top of case 22 are two conductive strips 52 and 52*a*. Placing coin 20 in slot 18 will actuate motor 60 and gears 26, which will in turn rotate arm 40 permitting projection 46 to push against and force open lid 12, and hand 42 will grasp the coin 20. With further movement of gears 26 arm 40 will lower hand 42 to its starting position, and end portion 50 of rod 48 will cause coin 20 to be pushed out of hand 42. Simultaneously plate 32 will move horizontally in channel 34 in response to rotation of gear 28 and movement of arm 30 so as to permit the bottommost coin in stack 38 to fall into the channel 34 and be pushed into opening 14.

FIG. 2 shows in detail the movement of the gears 26 in response to actuation of the motor 60. When coin 20 touches conductive strips 52, 52*a*, the motor rotates a gear 62 via shaft 64 which extends through a wall 66 of case 22. The gears are marked with numerals 1 through 5 to illustrate the sequence in which they are driven, and the arrows on the gears show the direction of rotation. Gear 62 drives gear 68 which rotates about axis 70. Pinion 72 rotates gear 74 which moves about axis 76. Pinion 78 on gear 74 rotates gears 80 and 82 which are coupled together on a common shaft, not shown, on axis 70. Gear 82 is inside case 22. Gear 82 rotates gears 84 and 28 which are ganged together via a common shaft, not shown, on axis 76. Gear 28 is connected to arm 30 as shown by arrow 86. Also rotated with gears 28 and 84 is a gear 88 to be described in conjunction with FIG. 7.

Figure 8:
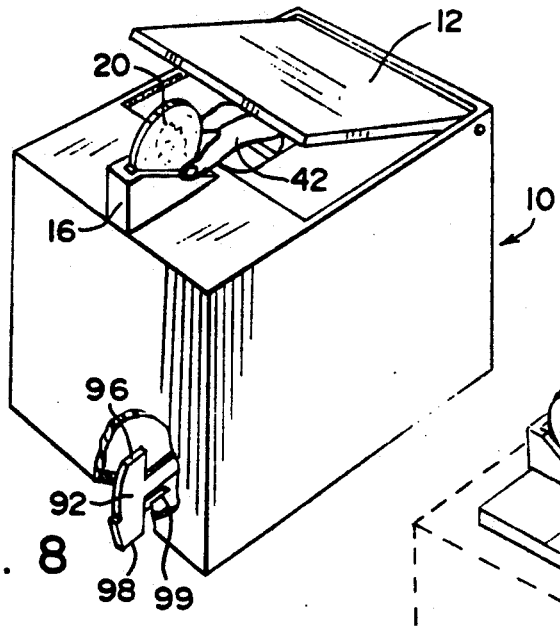

Attached circumferentially on one side of gear 84 are a plurality of horizontally extending pegs 90. A hammer shaped plastic element 92 is mounted for rotation about a shaft 94 attached to a wall of motor case 22. As gear 84 rotates, pegs 90 come into contact with top face 96 of element 92 such that the bottom portion 98 is pushed through an opening 99 in the bottom of case 10 as shown in FIG. 8. When the box 10 is sitting on a flat surface, downward movement of element 92 in response to rotation of gear 84 will force one end of case 10 to rise. When the peg 90 that caused the raising of the box passes out of contact with top face 96, the case 10 will return to its normal position on the surface. Further rotation of gear 84 will cause another peg 90 to push element 92 against the flat surface 96, again raising one end of box 10. This continual up and down motion of box 10 occurs immediately after coin 20 is inserted into slot 18 and adds an element of surprise and entertainment to the coin exchanger. FIG. 8 shows the location of element 92 when it is forced downwardly by a peg 90.

Operating arm 40 has a projection 100 at its end with an opening therein mounted for rotation about a shaft 102. The shaft 102 may be attached to a sidewall of case 22. A peg 104 extends from gear 84, and upon rotation of gear 84 the peg 104 will interact with a projection 106 of arm 40 to raise and lower the end of arm 40 containing hand 42. Such operation is shown in conjunction with FIGS. 3 and 4.

Figure 3:
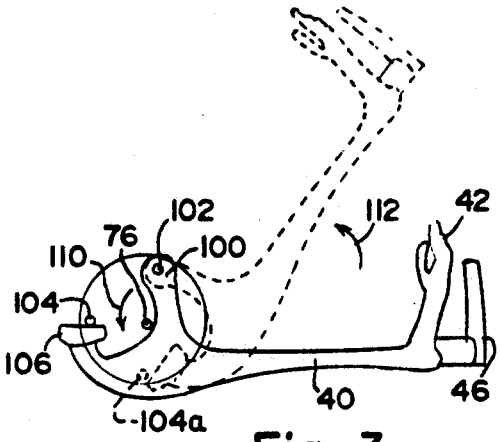

Referring to FIG. 3, gear 84 rotates in a direction shown by arrow 110 about axis 76. Arm 40 is rotatable about shaft 102. The solid lines show the arm 40 at rest before a coin is inserted and prior to actuation of motor 60, and the dashed lines show the arm 40 rotating and hand 42 moving upwardly shortly after motor 60 is actuated by insertion of coin 20 in slot 18. Upon rotation of gear 84 peg 104 moves in the direction of arrow 110 to the position shown at 104*a*, pushing against the flat face of projection 106 of arm 40 and causing rotation of the arm 40 in the direction of arrow 112 from the position shown by the solid lines to that shown by the dashed lines.

Figure 4:
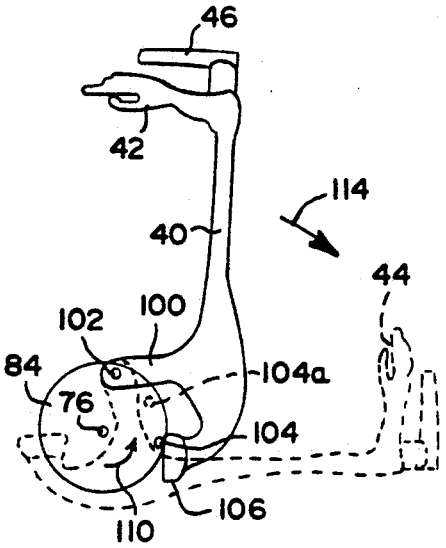
Figure 9:
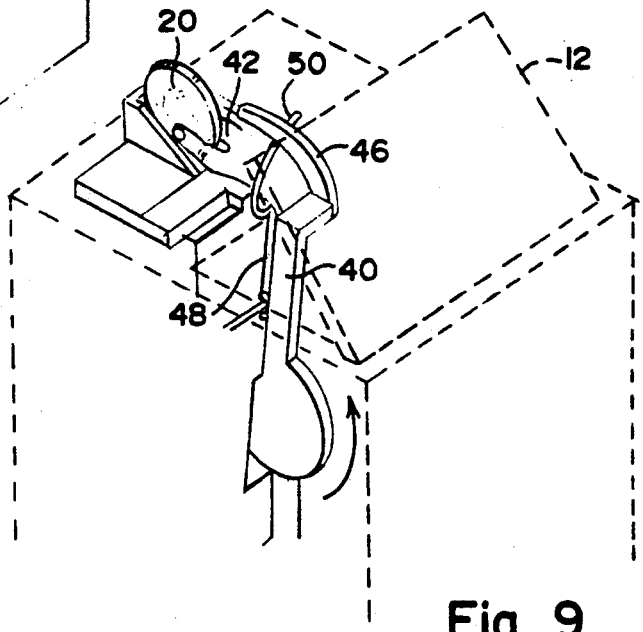

FIG. 4 shows in solid lines the topmost position of arm 40 where the coin 20 is grasped (see FIG. 9). In the topmost position the peg 104 is pushing against the edge of projection 106. With continued rotation of gear 84, peg 104 will move away from contact with projection 106 and fall into indentation 108. At this time the end of arm 40 with hand 42 will fall to the position shown by the dashed lines in the direction shown by arrow 114. At this time peg 104 will be located as shown at 104*a*.

Figure 5:
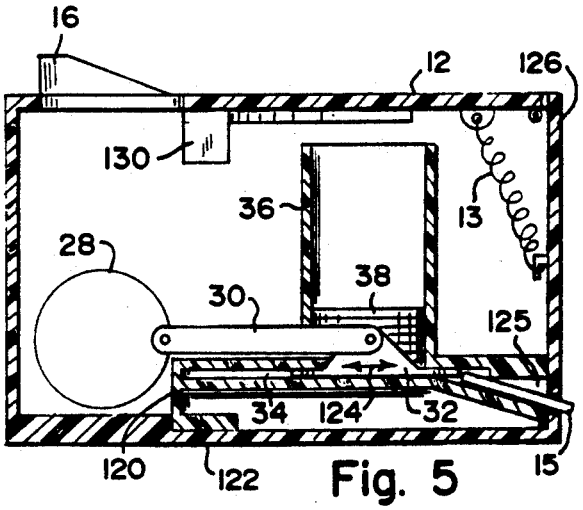
Figure 6:
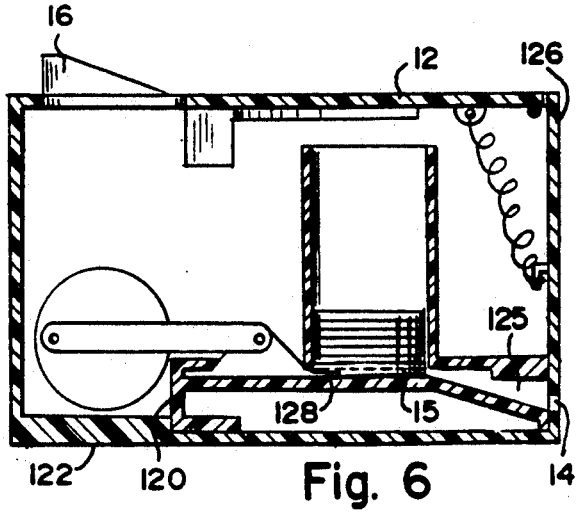

FIGS. 5 and 6 show the details of the reciprocating plate 32 connected to arm 30 which is in turn connected to gear 28. An element 120 of plastic is mounted inside box 10 on the bottom 122. Element 120 contains the channel 34 in which plate 32 moves back and forth as shown by arrow 124. Channel 34 opens into a space 125 also formed by the walls of element 120 and into opening 14 in sidewall 126. Element 36 which holds coins 38 including coin 15 (FIG. 5) is formed integral with the element 122.

In FIG. 6 the plate 32 is at its extreme left most position, and the bottommost coin 15 shown in dashed lines is located in channel 34 against a flanged portion 128 of element 32. As gear 28 rotates, arm 30 pushes plate 32 to the right and pushes coin 15 into space 125 as shown best in FIG. 5.

Also shown in FIGS. 5 and 6 is a spring 13 which pulls lid 12 closed after it has been raised by upward movement of hand 42. A plastic element 130 serves as a sill on which lid 12 rests when closed.

Figure 7:
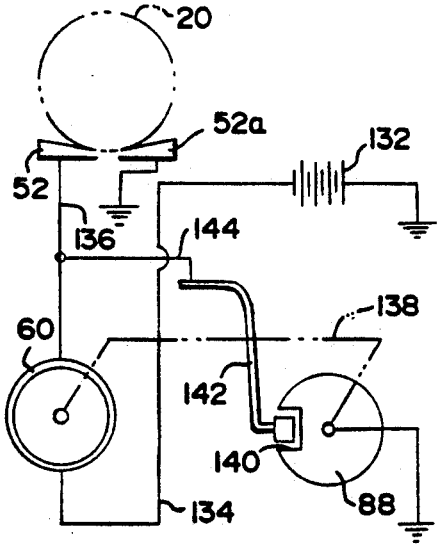

FIG. 7 shows the electrical circuitry which controls the operation of the coin exchanger. The batteries represented at 132 are connected at one end to ground or a common terminal and at the other through a line 134 to motor 60. A line 136 connects motor 60 with conductive strip 52. When coin 20 is in contact with both conductive strips 52, 52*a* the circuit is completed and motor 60 is actuated. When the coin 20 is removed, the circuit through the motor 60 is broken, but a second circuit connection will permit the motor 60 to continue to operate. Gear 88 which is metallic and electrically conductive rotates when motor 60 is actuated as shown by line 138. An insulator or cut away portion 140 is located on a portion of gear 88. An elongated spring contact 142 is connected between a line 144 and rest at insulator 140. Spring contact 142 is fixed within the box 10, and as gear 88 rotates the end of spring contact 142 is caused to contact gear 88 as it moves from rest position with the insulator 140 and contacts the metallic portion of gear 88. At this time a circuit path is completed from battery 132, line 134, motor 60, line 144, spring contact 142 and gear 88. With this secondary circuit path, motor 60 will continue to rotate even though the coin 20 is removed, and the motor 60 will continue to be energized until the contact 142 again comes into a rest position with insulator 140. The gears 26 are chosen to perform the operation described herein during the time that the motor 60 is actuated, and the motor will not start again until another coin 20 contacts conductive strips 52, 52*a*.

Figure 10:
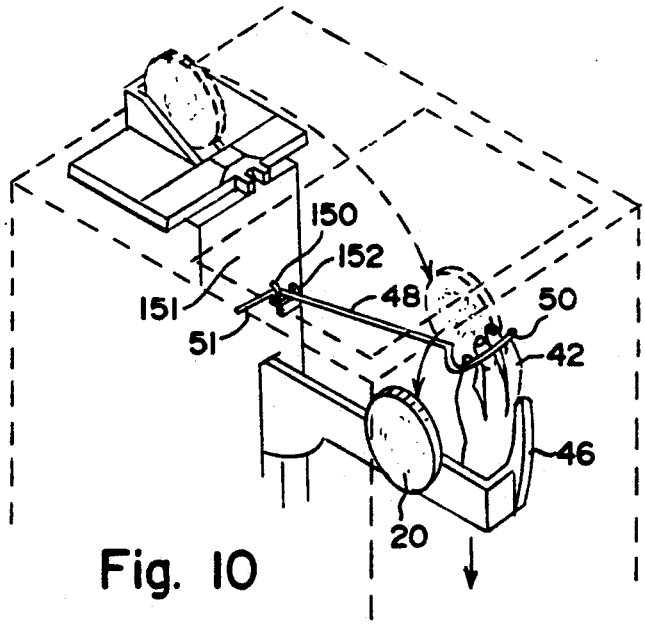

FIGS. 8, 9 and 10 show the operation of arm 40 and hand 42 as the hand grasps coin 20. As arm 40 rotates and hand 42 moves upward, the projection 46 contacts lid 12 and pushes it upward as shown best in FIG. 9. At the topmost position of hand 42, the space 44 between the thumb and index finger of the hand 42 contacts and surrounds coin 20 as shown in FIGS. 8 and 9. The space 44 is slightly narrower than the width of a coin, and hand 42 is constructed from a material that will permit the fingers of the hand on opposite sides of space 44 to open slightly and frictionally engage the coin 20. Coin 20 is then retracted into the box 10 by hand 42.

The end 50 of rod 48 comes in contact with projection 46 as hand 42 rises, and rod 48 is pushed upward with hand 42. The end 51 of rod 48 is hinged for rotation in a projection 150 mounted on a wall 151 of case 22. A stop 152 mounted on wall 151 below projection 150 prevents rod 48 from moving downwardly beyond the position shown in FIG. 10. As hand 42 moves downwardly from its topmost position together with the coin 20, the rod 48 will also move downwardly but will stop in the position shown in FIG. 10. As the hand 42 and coin 20 move further downwardly past end portion 50 of rod 48 as shown by arrow 154, the coin 20 will come into contact with end portion 50 and will then fall from the hand 42 and into the box 10 where it is stored.

Shown also in FIG. 8 is the slot 99 through the bottom of the box 10, and the plastic element 92 which protrudes through the slot 99 and causes the entire box 10 to life as previously described.

While this invention has been illustrated and described with respect to a preferred embodiment thereof, it is apparent that changes may be made in the construction and arrangement of parts without departing from the scope of the invention as hereinafter claimed.

What is claimed is:

1. A coin exchanger and amusement device comprising:

a) a box having a receptacle on the top thereof into which a coin or the like may be inserted, and also having an opening in one side wall thereof;

b) a motor means including a source of power within said box;

c) contact means connected with said source of power responsive to insertion of a coin into said receptacle for actuating said motor means;

d) coin grasping means contained within said box;

e) a lid on the top of said box normally closing the top of the box;

f) gear means connected with said motor means and actuable in response thereto;

g) means responsive to said gear means for rotating said coin grasping means upwardly to open said lid, reach out from said box into grasping engagement with said coin, and return grasping said coin into said box, said lid closing upon return of said coin grasping means into said box;

h) storage means holding a plurality of coins or the like different from said coin located within said box; and i) ejection means responsive to said gear means for ejecting one of said plurality of coins into said sidewall opening upon retraction of said coin grasping means into said box.

2. A coin exchanger as in claim 1 in which said motor means comprises:

a) storage battery means;

b) an electric motor; and c) means connecting said battery means with said electric motor.

3. A coin exchanger as in claim 2 in which said contact means comprises:

a) a pair of conductive strips parallel to each other, connected to said battery means and mounted on an insulator, said conductive strips being located immediately adjacent the bottom of said receptacle whereby a conductive coin inserted therein is in contact with both said conductive strips; and b) circuit means said connecting said battery and said electric motor with said conductive strips to cause actuation of said motor upon insertion of a coin into said receptacle.

4. A coin exchanger as in claim 3 in which said circuit means includes:

a) a metallic disk having an insulator attached to a portion thereof;

b) connector means having a first end connected to one of said pair of conductive strips and a second end in contact with the insulator connected on said disk; and c) means including said gear means responsive to actuation of said motor for rotating said disk and causing the second end of said connector means to contact the metallic portion of said disk and provide a conductive path for maintaining actuation of said motor upon removal of said coin from contact with said conductive strips.

5. A coin exchanger as in claim 1 in which said ejection means comprises:

a) a channel extending from said opening;

b) a reciprocating member within said channel; and c) means connecting said reciprocating member with said gear means to cause back-and-forth movement of said reciprocating member within said channel in response to actuation of said motor means.

6. A coin exchanger as in claim 5 in which said coin storage means comprises a vertically extending tube having adapted to contain therein said plurality of coins stacked back-to-back, the bottommost of said coins extending below the lowermost portion of said tube and being within said channel whereby movement of said reciprocating member will force said bottommost coin through said channel and into said sidewall opening.

7. A coin exchanger as in claim 1 in which said coin grasping means comprises:

a) a arm mounted in said box for rotation at a point adjacent one end thereof;

b) a simulated hand having its fingers extending upwardly attached to one end of said arm, said hand having a space between two adjacent fingers adapted to surround and grasp said coin in said receptacle;

c) means connected with said gear means for causing said arm to rotate such that the end of said arm having said hand moves upwardly through said lid to grasp said coin and thereupon return into said box; and d) a means for removing said coin from said hand when said hand returns within said box.

8. A coin exchanger as in claim 7 and including a projecting member mounted on said arm beyond said hand and adapted to push against and force open said lid upon upward movement of said arm.

9. A coin exchanger as in claim 1 and including:

a) an opening in the bottom of said box;

b) a member having a projection thereon adapted to extend through said opening and below the bottom of said box;

c) means for mounting said member for rotation about an axis; and d) means connected with said gear means for alternately forcing said member through said opening and returning said member within said box so as to cause said box to rise slightly when said member is forced below the bottom of said box.

* * * * *